US007928970B2

(12) United States Patent
Cho et al.

(10) Patent No.: US 7,928,970 B2
(45) Date of Patent: Apr. 19, 2011

(54) DISPLAY DEVICE AND CONTROL METHOD THEREOF

(75) Inventors: Jae-hyun Cho, Seoul (KR); Cheol-woo Park, Gyeonggi-do (KR); Ho-yong Jung, Gyeonggi-do (KR); Sung-jin Hong, Seoul (KR)

(73) Assignee: Samsung Electronics Co., Ltd. (KR)

( * ) Notice: Subject to any disclaimer, the term of this patent is extended or adjusted under 35 U.S.C. 154(b) by 930 days.

(21) Appl. No.: 11/520,401

(22) Filed: Sep. 12, 2006

(65) Prior Publication Data

US 2007/0057883 A1 Mar. 15, 2007

(30) Foreign Application Priority Data

Sep. 12, 2005 (KR) ..... 10-2005-0084610

(51) Int. Cl.
*G09G 5/00* (2006.01)
*G09G 3/36* (2006.01)

(52) U.S. Cl. ..... 345/205; 345/103

(58) Field of Classification Search ..... 345/87–100, 345/102, 103, 690
See application file for complete search history.

(56) References Cited

U.S. PATENT DOCUMENTS

| | | | | |
|---|---|---|---|---|
| 6,448,951 | B1 * | 9/2002 | Sakaguchi et al. | 345/88 |
| 6,583,777 | B2 * | 6/2003 | Hebiguchi et al. | 345/92 |
| 6,809,719 | B2 * | 10/2004 | Wu et al. | 345/103 |
| 7,728,810 | B2 * | 6/2010 | You et al. | 345/103 |
| 2003/0117355 | A1 * | 6/2003 | Yamauchi | 345/87 |
| 2005/0219188 | A1 * | 10/2005 | Kawabe et al. | 345/94 |
| 2007/0030233 | A1 * | 2/2007 | Chai et al. | 345/98 |

FOREIGN PATENT DOCUMENTS

| | | |
|---|---|---|
| CN | 1096882 | 12/1994 |
| CN | 1428630 | 7/2003 |
| CN | 1645469 | 7/2005 |
| JP | 07-199149 | 8/1995 |
| JP | 10-186311 | 7/1998 |
| JP | 2000-28985 | 1/2000 |
| JP | 2000-199886 | 7/2000 |
| JP | 2001-235729 | 8/2001 |
| JP | 2001-255506 | 9/2001 |
| JP | 2002-023135 | 1/2002 |
| JP | 2003-058080 | 2/2003 |
| JP | 2003-108102 | 4/2003 |
| JP | 2003-195820 | 7/2003 |
| JP | 2005-077471 | 3/2005 |
| JP | 2005-165331 | 6/2005 |
| JP | 2005-227764 | 8/2005 |
| KR | 2002-0039141 | 5/2002 |

OTHER PUBLICATIONS

Patent Abstracts of Japan, Publication No. 2000-028985, Jan. 28, 2000, 1 p.
Patent Abstracts of Japan, Publication No. 2000-199886, Jul. 18, 2000, 1 p.
Korean Patent Abstracts, Publication No. 1020020039141, May 25, 2002, 1 p.

* cited by examiner

*Primary Examiner* — Kevin M Nguyen
(74) *Attorney, Agent, or Firm* — Innovation Counsel LLP

(57) ABSTRACT

A liquid crystal display device employing the color sequential display method includes multiple, different color light sources. An image data arranging circuit sorts image data input from an external source for each frame according to color and arranges the sorted image data into a plurality of sub-frames. A data driver applies the arranged image data for each color to the liquid crystal panel sequentially according to the sub-frames.

10 Claims, 4 Drawing Sheets

DISPLAY DEVICE AND CONTROL METHOD THEREOF

CROSS-REFERENCE TO RELATED APPLICATIONS

This application claims priority from Korean Patent Application No. 2005-0084610, filed on Sep. 12, 2005, in the Korean Intellectual Property Office, the disclosure of which are incorporated herein by reference.

FIELD OF INVENTION

The present invention relates to a display device and a control method therefor and, more particularly, to a display device based on the field sequential color (FSC) method or the color sequential display (CSD) method.

DESCRIPTION OF THE RELATED ART

The popular liquid crystal display (LCD) includes a liquid crystal panel having a thin film transistor (TFT) substrate on which thin film transistors are formed and a color filter substrate on which a color filter layer is formed. A liquid crystal layer is interposed between the TFT substrate and the color filter substrate. A color filter layer formed on the color filter substrate is comprised of the three primary colors red (R), green (G) and blue (B). The color filter substrate controls the amount of white light transmitted to the RGB color filter layer and mixes the RGB colors to display a required color.

Instead of using a white light source and color filter substrate, it would be possible to use a field sequential color (FSC) method or a color sequential display (CSD) method that uses three-color light sources that are capable of obtaining images of full color by activating independent light sources for each of the RGB colors sequentially and periodically at each conventional pixel. A color signal corresponding to the each conventional pixel is applied synchronously with the activation of the light sources.

Since a pixel is not divided into three sub-pixels in these methods, there are advantages that aperture ratio and yield can be readily improved and that the number of driving circuits needed for each sub-pixel can be lowered.

However, the conventional method of data conversion to the display device is not appropriate for implementation of the CSD method. For example, the conventional data method applies RGB image data line by line because only a single light source is provided. When three light sources are available transmitting RGB image data to each pixel will not appropriately reproduce the image.

SUMMARY OF THE INVENTION

Accordingly, it is an aspect of the present invention to provide a display device and control method thereof, which is capable of adopting a color sequential display method with a minimum change in image data. In accordance with the invention an image data arranging circuit is provided which, for each frame, sorts the input image data input according to color and arranges the sorted image data sequentially according to the color to form a plurality of sub-frames, one for each light source. A memory unit stores the sub-frames constituting each frame. It is an aspect of the illustrative embodiment that the same gate signal is applied to the pixels of at least two, and preferably, three rows. The data driver which applies the arranged image data for each color to the pixels sequentially according to the sub-frames.

BRIEF DESCRIPTION OF THE DRAWINGS

The above and/or other aspects and advantages of the prevent invention will become more apparent from a reading of the ensuing description when read together with the drawing, in which.

DETAILED DESCRIPTION

Figure 1:
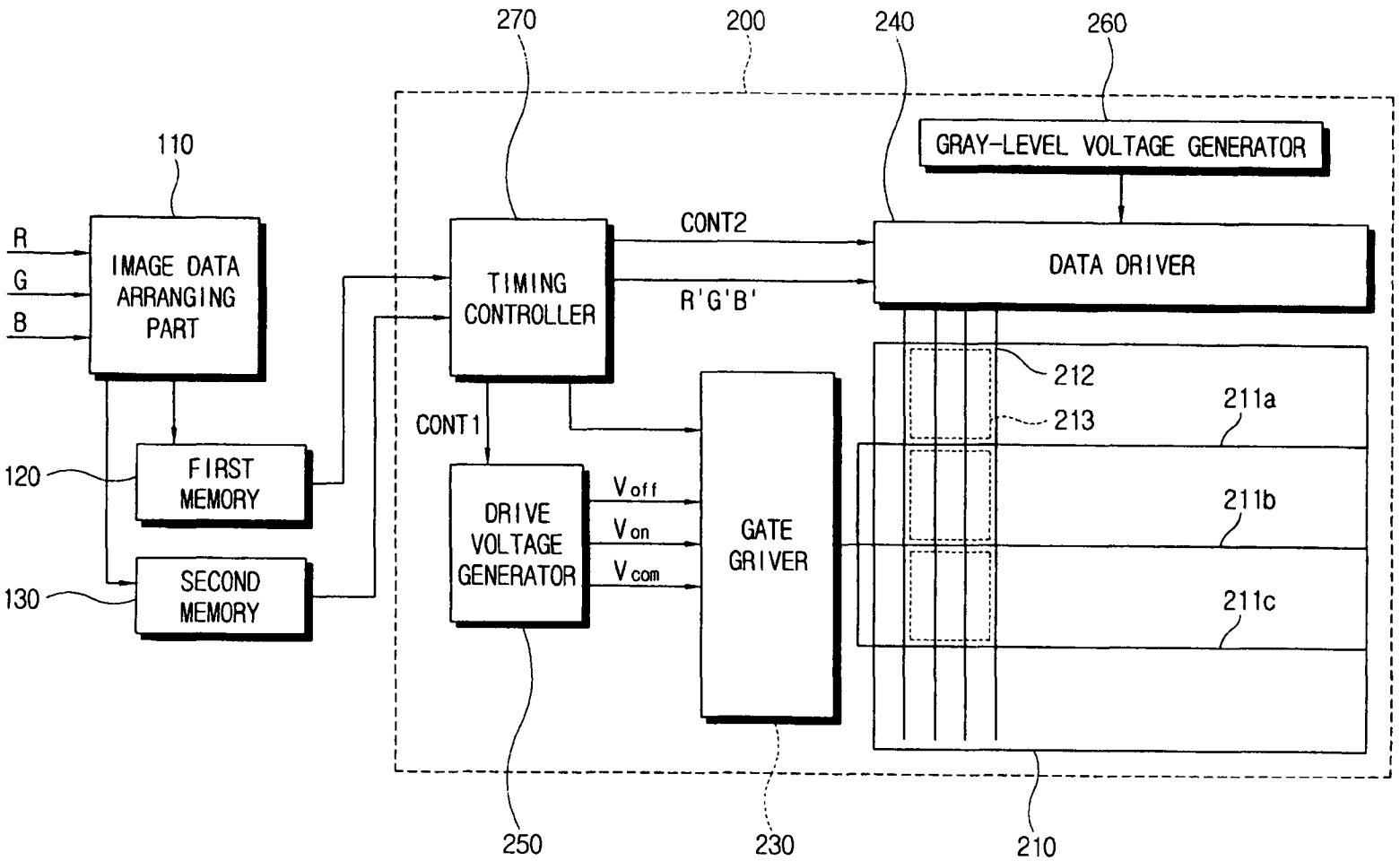
FIG. 1 illustrates a block diagram of a display device in accordance with an embodiment of the present invention.

As shown in FIG. 1, a display device in accordance with the present embodiment includes an image data arranging circuit 110, a pair of memories 120, 130 and a liquid crystal module 200. The liquid crystal module 200 has a liquid crystal panel 210 and a driving circuit for driving the liquid crystal panel 210, which is provided with a gate driver 230, a data driver 240, a drive voltage generator 250, a gray-level voltage generator 260 and a timing controller 270.

Signal lines 211, 212 and pixels 213 which are formed on the liquid crystal panel 210 will be described in detail with reference to FIG. 3. Liquid crystal panel 210 is provided with a plurality of data lines 212*a*, 212*b*, 212*c*, and gate lines 211 that intersect the data lines to form the pixels 213 arranged into a matrix array. Thin film transistors 214 are disposed at the points of intersection of gate lines 211 and data lines 212. Further, control signals and image data are applied to the gate lines 211 and data lines 212 through the gate driver 230 and data driver 240, respectively.

Figure 3:
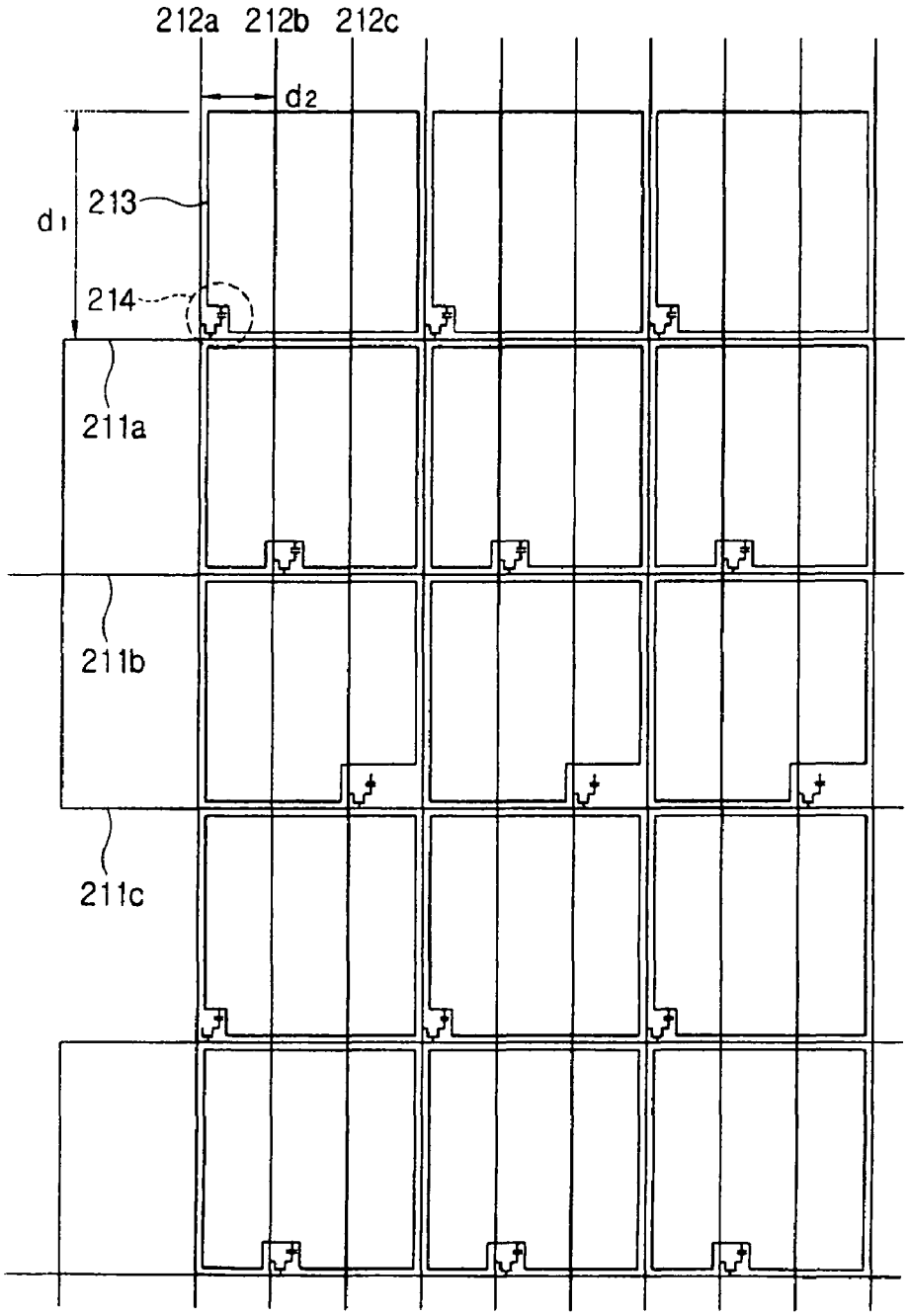
FIG. 3 shows a plan view of pixels in accordance with the embodiment of the present invention.

In the present invention, referring to FIGS. 1 and 3, pixel 213 means one square defined by three data lines 212*a*, 212*b*, 212*c* and one gate line 211 and refers to a dot displaying one color. The pixel electrode ITO means a physically transparent electrode constituting the pixel 213. During one gate-on time, gate driver 230 applies one gate signal to the three gate lines 211*a*, 211*b*, 211*c* that are connected to each other at one end. When the gate signal is applied to the three gate lines 211*a*, 211*b*, 211*c* connected to each other at their one ends, the gate-on time is three times longer than that of the prior art. Since the period of time when the data signal is applied to pixels 213 is longer by the extended gate-on time, the pixel charging rate is improved. Further, since the number of the gate lines 211 to which the gate signals are applied is reduced to one third of the number of the prior art, the number of gate pads and the number of the gate driver 230 can also be reduced by one third. In the present embodiment, although the number of the gate lines 211 connected to each other at their one ends is three, that is just an example and can be more than three. Further, as the size of the display device becomes greater and the applied frequency becomes higher, demand for improving the low pixel charging rate caused by a short gate-on time will increase. Thus, the present invention, in which one gate signal is applied to a plurality of the gate lines simultaneously, is also applicable to impulsive driving display devices generating a black screen as well as color sequential display (CSD) ones, since the gate lines should be driven two times more rapidly than the number of repetition of a flame shown to a user.

Data lines 212 intersect with the gate lines 211 to form pixels 213 arranged in a matrix array, and data lines 212*a*, 212*b*, 212*c* are connected respectively to each pixel 213 which receives the same gate signal. The pixel 213 is a square with four sides of length d1. Two of the three data lines (212*b* and 212*c*) pass through pixel 213 one-third the length d1 away from the right and the left side of the pixel, respectively. The remaining one, i.e., data line 212*a*, is disposed at the side of the pixel 213. The three data lines 212*a*, 212*b*, 212*c* divide one side of the pixel 213 into three parts each of length d2.

Neighboring pixels in the same column (i.e., the direction of data lines 212) are connected to the three gate lines 211*a*, 211*b*, 211*c*, respectively. Thus, the same gate signal is applied to the pixels 213 disposed in three adjacent rows. The thin film transistors 214 disposed at the intersection points of the three gate lines 211*a*, 211*b*, 211*c* and the three data lines 212*a*, 212*b*, 212*c* are connected to the pixels 213 so that the same data signal is not applied to more than one neighboring pixel in the column. The data signal from the first data line 212*a* is applied to the pixel 213 driven by the first gate line 211*a* of the first row, the data signal from the second data line 212*b* is applied to the pixel 213 driven by the second gate line 211*b* of the second row, and the data signal from the third data line 212*c* is applied to the pixel 213 driven by the third gate line 211*c* of the third row. Thus, different data signals are applied to the pixels 213 of adjacent rows.

The number of data lines 212 prepared for the each pixel 213 corresponds to the number of the rows of the pixels 213 neighboring each other in the extension direction of data lines 212 and receiving the same gate signal, i.e., the number of the gate lines 211 connected to each other at their one ends. Thus, the number of data lines 212 prepared for the each pixel 213 is increased if the number of the gate lines 211 connected to each other at their one ends is increased. As aforementioned, more than three gate lines 211 can be connected to each other at their one ends.

Thin film transistor 214 applies the gate signal input by gate line 211 and the data signal input through data line 212 to pixel 213. As shown in FIG. 3, the thin film transistors 214 neighboring each other in a column direction are connected to the different data lines 212*a*, 212*b*, 212*c*, respectively.

Image data arranging circuit 110 sorts and arranges image data corresponding to one frame input from an external source according to the color. Arranged image data are alternately stored in first memory 120 and second memory 130. Image data are applied on a line by line basis along the extension direction of gate lines 211 to display an image. One frame is constituted by the image data for the pixels of rows equal to the number of the gate lines 211. The image data arranging circuit 110 sorts and arranges the RGB image data mixed in each pixel row according to color.

Figure 2:
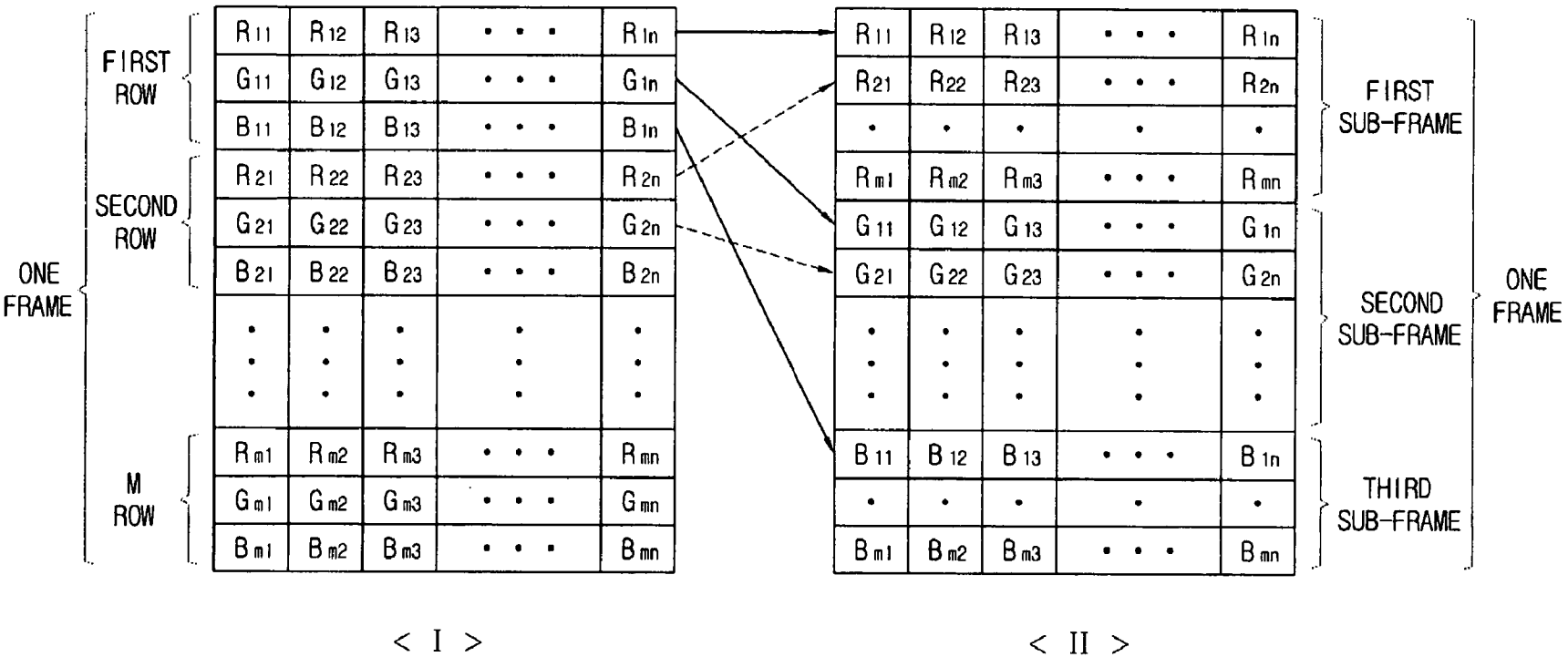
FIG. 2 offers two tables for illustrating an image data arrangement in accordance with the embodiment of the present invention.

The arrangement of the image data will now be described more in detail with reference to FIG. 2. In FIG. 2, a first table I illustrates the image data sorted according to color. In the prior art, when a pixel for representing one color is defined as a dot, three sub-pixels form one dot. Therefore, to display n×m dots constituting one frame, the image data corresponding to 3×n×m sub-pixels are input to the image data arranging circuit 110. The image data arranging circuit 110 sorts 3n image data corresponding to one row according to the RGB color. As shown in the drawing, the RGB image data corresponding to a first row are sorted into n image data for each color. The input m-row image data are sorted into 3m-row image data by the image data arranging circuit 110. Since the input color of the image data is three, i.e., red (R), green (G) and blue (B), the image data are sorted into 3m-row image data. If the input color of the image data is four or six, the image data is sorted into 4m or 6m-row image data.

The thus sorted image data are stored in the first memory 120 or the second memory 130 sequentially according to the color as in table II shown in FIG. 2. As shown in the drawing, the RGB image data corresponding to the first row are stored at a beginning point and two trisection points of the entire memory 120 or 130. The image data corresponding to a second row are stored sequentially in the next row of the image data of each color corresponding to the first row.

As described above, the one frame is arranged into three sub-frames which are formed of the total RGB image data for three colors, respectively. The number of the sub-frames is identical to the number of input colors of the image data, which is identical to the number of colors of lights supplied from a light source. The image data arranging circuit 110 sorts the image data input thereto to form as many sub-frames as the number of the colors of the lights supplied from the light source during one frame. When the image data of a specific color is applied to the liquid crystal panel 210, a light corresponding to the color of the image data is supplied synchronously.

The image data for frames are alternately stored in memory 120 and memory 130. While the image data sorted and arranged in the image data arranging circuit 110 are stored in the first memory 120, the image data stored in the second memory 130 are applied to the liquid crystal panel 210. This means that after the image data corresponding to one frame are applied to the liquid crystal panel 210 completely, the image data stored in the other memory and corresponding to a different frame begins to be read. Therefore, since the processing of the image data is not performed while one frame is formed in the liquid crystal panel 210, the images are displayed without stopping.

Further, if only one memory is used, the data processing speed should be over two times faster than that of the present invention since the image data should be sorted and arranged while, at the same time, being applied to the liquid crystal panel 210. In a case where the data processing speed of the image data arranging circuit 110 does not keep up with that speed, there may occur a problem that the image data are not applied to the liquid crystal panel 210 adequately, so two memories 120, 130 are employed. Therefore, the number of the memories is not limited to two, and can be varied according to the amount of data constituting one frame, the processing speed of the image data arranging circuit 110 or the like.

Gate driver 230, called a scan driver, is connected to the gate lines 211 to apply thereto gate signals constituted by a combination of gate-on voltages Von and gate-off voltages Voff from the drive voltage generator 250.

Data driver 240, called a source driver, receives gray-level voltages from the gray-level voltage generator 260, and selects some of the gray-level voltages according to control of the timing controller 270 to apply RGB image data voltages to data lines 212. A plurality of gate driver integrated circuits (IC's) or data driver integrated circuits (IC's) may be attached to the liquid crystal panel 210 through a tape carrier package (TCP) after being surface mounted thereon or directly attached on a glass substrate according to chip on glass mounting. Alternatively, circuits performing the functions of these (IC's) can be directly surface mounted on the liquid crystal panel 210.

Drive voltage generator 250 generates the gate-on voltage Von for turning on the thin film transistor 214, the gate-off voltage Voff for turning off the thin film transistor 214, and a common voltage Vcom applied to a common electrode (not shown).

Gray-level voltage generator 260 generates a plurality of the gray-level voltages relating to brightness of the display device. The timing controller 270 generates control signals for controlling performance of the gate driver 230, data driver 240, the drive voltage generator 250 and the gray-level voltage generator 260 to supply them to the gate driver 230, data driver 240 and the drive voltage generator 250, respectively. Timing controller 270 is supplied from an external graphic controller (not shown) with RGB three-color image data R, G, B and input control signals for controlling display thereof, such as vertical synchronizing signals, horizontal synchronizing signals, main clock signals and data enable signals.

Timing controller 270 transmits the gate control signals CONT1 to the gate driver 230 and the drive voltage generator 250 according to the input control signals, and transmits image data R', G', B' converted in the image data arranging circuit 110 and data control signal CONT2 to data driver 240. Gate control signal CONT1 includes a vertical synchronization start signal for indicating start of output of a gate-on pulse (gate-on voltage interval), a gate clock signal for controlling an output timing of the gate-on pulse and a gate-on enable signal for limiting a width of the gate-on pulse. Data control signal CONT2 includes a horizontal synchronization start signal for indicating start of input of the image data R', G', B', and a load signal for applying corresponding voltages to data lines 212. First, gray-level voltage generator 260 supplies to data driver 240 the gray-level voltages having voltage values determined according to voltage selection control signals.

Gate driver 230 sequentially applies the gate-on voltages Von to the gate lines 211 according to the gate control signals CONT1 to turn on the thin film transistors 214 connected to the gate lines 211. The single gate-on/off signal is applied to the three gate lines 211. At the same time, data driver 240 receives the image data R', G', B' corresponding to the pixels 213 connected to the thin film transistors 214 turned-on by data control signals CONT2. Data driver 240 selects the gray-level voltages corresponding to the individual image data R', G', B' among the gray-level voltages from the gray-level voltage generator 260 and converts the image data R', G', B' into corresponding voltages.

Although the three data lines 212 are disposed at the one pixel 213 in accordance with the present embodiment, the three data lines 212 are connected to the different pixels 213 neighboring each other in the extension direction (column direction) of data lines 212. When the one gate signal is applied, the thin film transistors 214 connected to the three gate lines 211 are turned on. Therefore, data image corresponding to three rows are applied at once. That is, the image data corresponding to three rows shown in the table II of FIG. 2 are applied to the liquid crystal panel 210 simultaneously, and the first (or R) sub-frame, the second (or G) sub-frame and the third (or B) sub-frame of the image data corresponding to the one frame are applied in that order. While the image data corresponding to the one frame are being applied, the light source supplies a light of a color corresponding to each of the sub-frames. In other words, the light source supplies to the liquid crystal panel 210 lights of different colors sequentially with a period of one frame.

The data signal supplied to data lines 212 are applied to the corresponding pixels 213 through the turned-on thin film transistors 214. Like this manner, the gate-on voltages are applied sequentially to all the gate lines 211 during the one frame, so that the data signals are applied to all the pixels 213.

Figure 4:
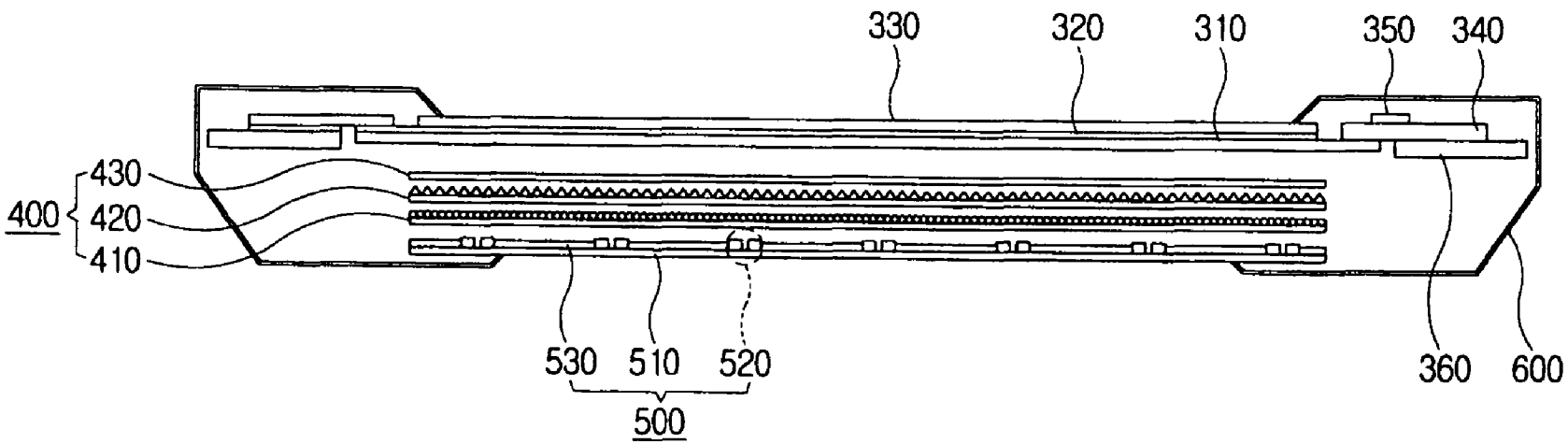
FIG. 4 depicts a cross-sectional view of the display device in accordance with the embodiment of the present invention.

Referring to FIG. 4, there is illustrated a cross-sectional view of a liquid crystal display device in accordance with the present embodiment. As shown in the drawing, the display device includes a liquid crystal panel having a first substrate 310, a second substrate 330 and a liquid crystal layer 320 injected between both the substrates 310, 330, a light source 500 disposed on a rear surface of the liquid crystal panel to supply light thereto, a light control member 400 and an outer frame 600 for supporting and housing the liquid crystal panel and the light source 500.

The liquid crystal panel includes the first substrate 310 on which the pixels 213 and the thin film transistors 214 shown in FIG. 2 are formed, the second substrate 330 facing the first substrate 310 and having a black matrix, a white filter and a common electrode, a sealant combining both the substrates 310, 330 while forming a cell gap therebetween, and the liquid crystal layer 320 disposed between both the substrates 310, 330 and the sealant. The liquid crystal panel forms a screen by adjusting alignment of the liquid crystal layer 320, but since it is a non-light-emitting device, a light source, such as a light emitting diode (LED) 520 disposed on its rear surface, supplies light thereto.

At one side portion of the first substrate 310, a driving circuit for applying driving signals is provided. The driving circuit includes a flexible printed circuit board 340, a driving chip 350 mounted on the flexible printed circuit board 340, and a printed circuit board 360 connected to an outer end portion of the flexible printed circuit board 340. The driving circuit shown in the drawing is of a chip on film (COF) method, and may be of a tape carrier package (TCP), COG (chip on glass) or other publicly known methods. Further, the driving circuit may be formed on the first substrate 310 during a circuit formation process.

The light control member 400 may include a diffusion plate 410, a prism film 420 and a protective film 430.

The diffusion plate 410 is constituted by a base plate and a coating layer with spherical beads formed on the base plate. The diffusion plate 410 diffuses light supplied from the light emitting diodes 520 to lender brightness uniform. The prism film 420 is provided with triangular column-shaped prisms formed on its upper surface with a predetermined alignment. The prism film 420 serves to collect light diffused in the diffusion plate 410 in a direction perpendicular to a disposition plane of the liquid crystal panel thereabove. It is usual to employ the two prism films 420, which are disposed such that the micro prisms formed on each of the prism films 420 form a predetermined angle with each other. Most of the light which has passed through the prism film 420 propagates vertically to present a uniform brightness distribution. A reflective polarizing film may be used together with the prism film 420, if necessary. It may be possible to use the reflective polarizing film alone without the prism film 420.

The protective film 430 disposed uppermost protects the prism film 420 vulnerable to scratches. A reflection plate 530 is provided on a portion of a LED circuit board 510 on which the light emitting diodes 520 are not mounted. On the reflection plate 530, LED-accommodating holes corresponding to the disposition of the light emitting diodes 520 are formed. Most parts of the light emitting diodes 520 including a chip (not shown) generating light are disposed higher than the reflection plate 530. The reflection plate 530 serves to diffuse the light incident on its lower surface to supply it to the diffusion plate 410. The reflection plate 530 may be made of polyethylene terephthalate (PET) or polycarbonate (PC), and may be coated with silver or aluminum. Further, the reflection plate 530 may be formed to be somewhat thicker not to be generated creases by the strong heat produced by the light emitting diodes 520.

Light emitting diodes 520 are mounted on the LED circuit board 510, and disposed over the entire rear surface of the liquid crystal panel. The light emitting diode 520 is constituted by a combination of a red LED, a blue LED and a Green LED emitting three color lights, and supplies the three color lights to the liquid crystal panel sequentially with a period of one frame. The colors of lights supplied by the light emitting diode 520 may be cyan, magenta and yellow, or may be other combination including them.

Light source 500 may be a direct type in which light is supplied below the liquid crystal panel as in the liquid crystal panel in accordance with the present embodiment. An edge type one supplying light from sides of the liquid crystal panel may also be applicable. As described above, in accordance with the present invention, there is provided a display device and control method thereof, which is capable of adopting a color sequential display method with a minimum change in the image data.

Although a few exemplary embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A display device comprising a liquid crystal pane, wherein the liquid crystal panel includes:

a plurality of pixels arranged in a matrix array, wherein each pixel comprises a pixel electrode;

a plurality of gate lines, a gate line being disposed per pixel row, a first number of the plurality of gate lines transmitting a same gate signal wherein the first number is at least two;

a plurality of data lines intersecting the gate lines, wherein a number of the data lines arranged per a pixel column is equal to the first number; and thin film transistors connected to the gate lines, the data lines, and the pixel electrodes of the pixels, wherein one thin film transistor is disposed every said first number of the data lines in a pixel row;

wherein the pixel electrode fully overlaps a second number of data lines in a row direction wherein the second number is equal to the first number subtracted by one.

2. The display device of claim 1, further comprising:

an image data arranging circuit which sorts image data for one frame being input from an external source according to color and arranges the sorted image data sequentially according to the color to form a plurality of sub-frames constituting the one frame;

a first memory and a second memory that sequentially store the sub-frame of the arranged image data alternately by frames;

a data driver which applies the arranged image data for the each color to the liquid crystal panel sequentially according to the sub-frames; and a light source which supplies lights of at least two colors different from each other to the liquid crystal panel sequentially with a period of the one frame;

where the arranged image data for one frame stored in the second memory is applied to the liquid crystal panel while the arranged image data for a next frame is stored in the first memory.

3. The display device of claim 2, wherein the number of the sub-frames is identical to the number of colors of the light supplied by the light source.

4. The display device of claim 2, wherein the number of the sub-frames is three.

5. The display device of claim 2, wherein the light source supplies a red light, a green light and a blue light.

6. The display device of claim 1, wherein the gate lines which supply the same gate signal to the pixel electrodes are connected to each other.

7. The display device of claim 1, wherein the first number is three.

8. The display device of claim 1, wherein the second number of data lines overlapping the pixel electrode divide the corresponding pixel electrode into substantially equal parts.

9. The display device of claim 8, wherein the number of the data lines provided at a pixel column is identical to the number of pixel rows to which the same gate signal is applied.

10. The display device of claim 8, wherein the pixel electrodes neighboring each other in an extension direction of the data lines, to which the same gate signal is applied, are connected to the data lines different from each other.

* * * * *